United States Patent [19]

Stewart

[11] Patent Number: 4,538,155

[45] Date of Patent: Aug. 27, 1985

[54] ANTENNA MOUNT WITH ROTARY POSITIONABLE FEATURE

[76] Inventor: William H. Stewart, 13610 Beech St., Milwaukie, Oreg. 97222

[21] Appl. No.: 390,987

[22] Filed: Jun. 22, 1982

[51] Int. Cl.[3] ..... H01Q 1/32; H01Q 1/08

[52] U.S. Cl. ..... 343/715; 343/882

[58] Field of Search ..... 343/709–711, 343/713–715, 878, 880–882, 885, 888, 890, 892, 900; 52/110, 111; 248/534, 541, 478; 211/190, 208

[56] References Cited

U.S. PATENT DOCUMENTS

| | | | |
|---|---|---|---|
| 2,186,934 | 1/1940 | Palmer | 343/900 |
| 2,270,514 | 1/1942 | Doane et al. | 343/882 |
| 2,329,200 | 9/1943 | Hefele | 343/882 |
| 2,334,503 | 11/1943 | Paton | 343/714 |
| 3,886,560 | 5/1975 | Mortensen et al. | 343/709 |
| 3,928,952 | 12/1975 | Whyte | 343/888 |
| 4,101,897 | 7/1978 | Morrison | 343/715 |
| 4,107,695 | 8/1978 | Urban et al. | 343/713 |

FOREIGN PATENT DOCUMENTS

| | | | |
|---|---|---|---|
| 2900269 | 6/1979 | Fed. Rep. of Germany | 343/715 |

*Primary Examiner*—E. Lieberman
*Assistant Examiner*—Michael C. Wimer
*Attorney, Agent, or Firm*—Klarquist, Sparkman, Campbell, Leigh & Whinston

[57] ABSTRACT

An adjustable transceiver antenna mount in which the force required for adjustment is such as to facilitate one-hand operation, enabling the driver to adjust the antenna position from the driver's seat. With internal controls, the driver is able to do so without even opening the window. The mount has a releasable positive locking action and also a serially arranged fail-safe friction connection. The mount provides for connection of the coax cable to a fixed component of the mount to eliminate cable flexing. The mount provides a sealed housing for the connection. The mount provides embracing electrical contact elements for a main shaft. These are pressed against the shaft by a compression spring arrangement which also urge releasable antenna locking members to remain in engagement. The mount has other features recited in the body of the specification.

6 Claims, 21 Drawing Figures

ANTENNA MOUNT WITH ROTARY POSITIONABLE FEATURE

This invention relates to an antenna mount for a vehicle, such as a motor vehicle, recreational vehicle or other land and water vehicles. The invention more particularly relates to a mount for the antenna of a transceiver, where signals are not only received but also sent.

While there are other transceiver antenna mounts which permit an antenna to be moved from an upright position to a lowered position, for clearance purposes, the ones of which I am aware have one or more of the following disadvantages:

(1) they depend upon friction for holding the antenna in its various positions. In order to do this under normal driving conditions, the frictional force must be so substantial that both hands are required for antenna position adjustment. Thus, for all practical purposes this precludes the adjustment of the antenna while remaining in the vehicle, and while the vehicle is under way.

(2) The connection between the coaxial cable and the mount or antenna is exposed to the elements, and the connection or the cable becomes corroded or otherwise affected such that its radio frequency energy conductive characteristics are adversely affected.

(3) The coaxial cable is directly connected to the antenna and thus must flex with antenna movement. This is detrimental to the service life of the cable and to the maintenance of a proper radio frequency connection through the cable to the antenna.

SUMMARY OF THE INVENTION

I overcome the above problems by providing a transceiver antenna mount which does not have the above disadvantages and yet is reasonably simple and inexpensive considering the functions it performs.

In my antenna mount, the arrangement is such that the force required to adjust the position of the antenna is of such a reasonable magnitude, that the antenna can be adjusted to any of its positions of adjustment by the use of only one hand, therefore enabling the driver of a vehicle to adjust the antenna position with one hand, either while stopped or with the vehicle underway.

When side, or top-corner, mounted, my mount permits the antenna's position to be adjusted from inside or outside the vehicle. Thus, with inside control, it is unnecessary even to lower the window in order to operate the antenna in extremely cold climates or bad weather.

In another version, where the antenna is mounted at the center of the roof, the operator while seated in the vehicle can reach out with one hand and by a remote control arrangement adjust the position of the antenna.

The one-hand operation of my mount permits adjustment of the antenna position while the vehicle is underway, i.e., while it is moving. An example of this, a driver, upon approaching a service station marquee, can lower the antenna to its out of the way position, without stopping the vehicle.

My transceiver antenna mount is also so constructed as to provide for a positive locking arrangement between the antenna and the mount body in several desired positions. It also provides, as a fail-safe feature, a frictional connection which has sufficient resistance to movement to maintain the antenna in its upright position against wind forces and the like, but will permit the antenna upon inadvertent engagement with another object, to be moved by such engagement to a lowered position.

My antenna mount also has, instead of a direct electrical connection between the coaxial cable and the antenna, an indirect connecting arrangement which prevents flexing but nevertheless provides for wholly adequate radio frequency energy conduction between the antenna and the cable.

In my antenna mount, the above connection is contained within a water-tight sealed shell so as not to be exposed to the elements.

Other features of my mount include the maintenance of electrical conductivity between the antenna and the coaxial cable in all positions of adjustment of the antenna; and optional mounting arrangements permitting the mounting device to be fastened or secured in any of a number of places on the vehicle, etc.

A main object of the invention is to provide an improved transceiver antenna mount having one or more of the advantages recited above.

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

DESCRIPTION OF PREFERRED EMBODIMENT

Figures 1, 2, 3, 4, 5, 6, 7, 8, 9, 10, 11:
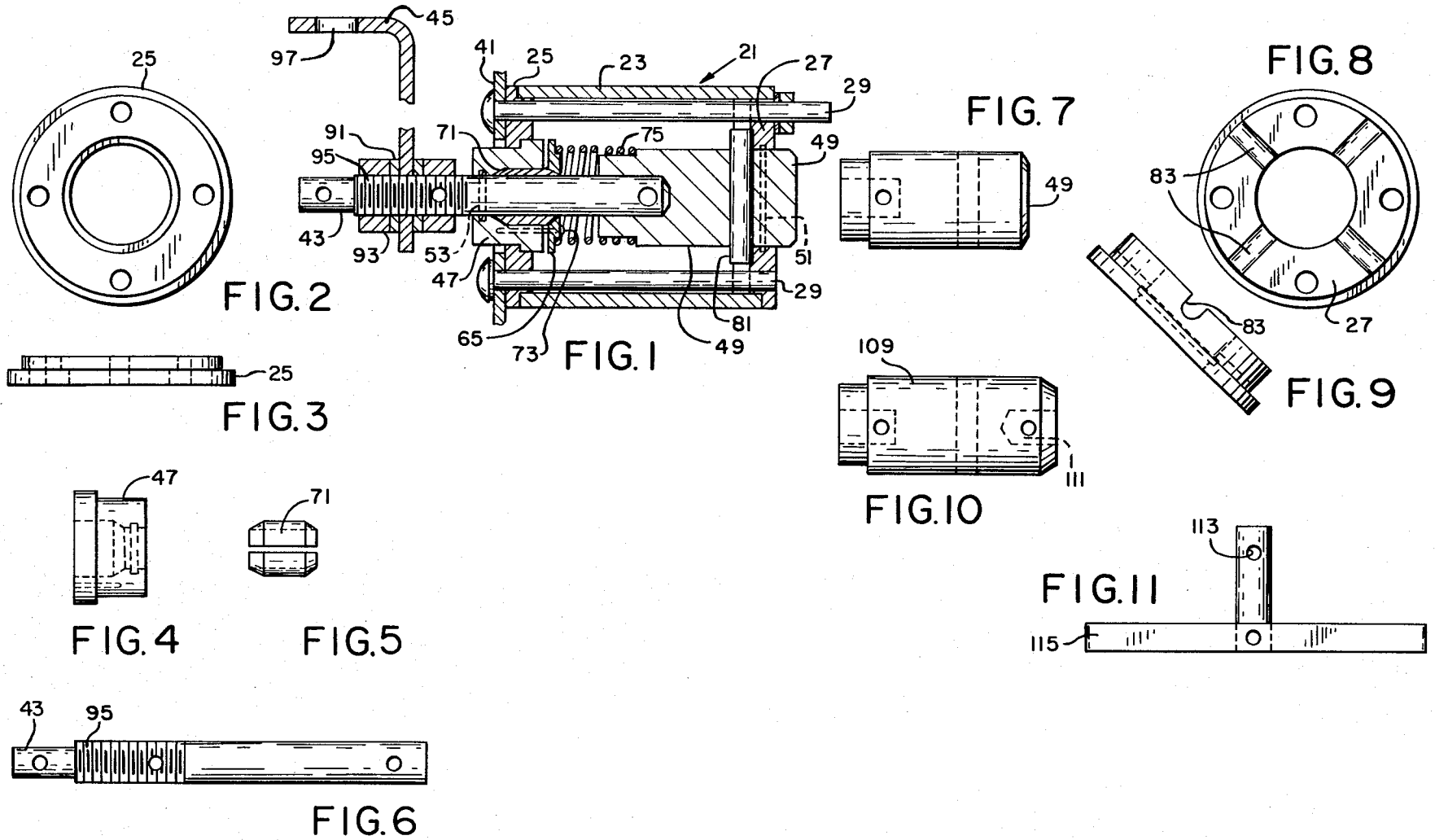
FIG. 1 is a midsectional view through a transceiver antenna mount of the present invention.
FIG. 2 is an end view of the front plate of the mount.
FIG. 3 is an edge view of such plate.
FIG. 4 is a side view of the front bushing of the mount.
FIG. 5 is a side view of the contact cones.
FIG. 6 is a view of the shaft isolated from the remaining parts.
FIG. 7 is a side view of the rear bushing.
FIG. 8 is a face-on view of the inside face of the rear plate.
FIG. 9 is an edge view of the rear plate.
FIG. 10 shows a modified form of rear bushing permitting inside-of-the-vehicle adjustment of the antenna position.
FIG. 11 is a view of the inner handle for use with the FIG. 10 bushing.
Figures 12, 13, 14, 15, 16:
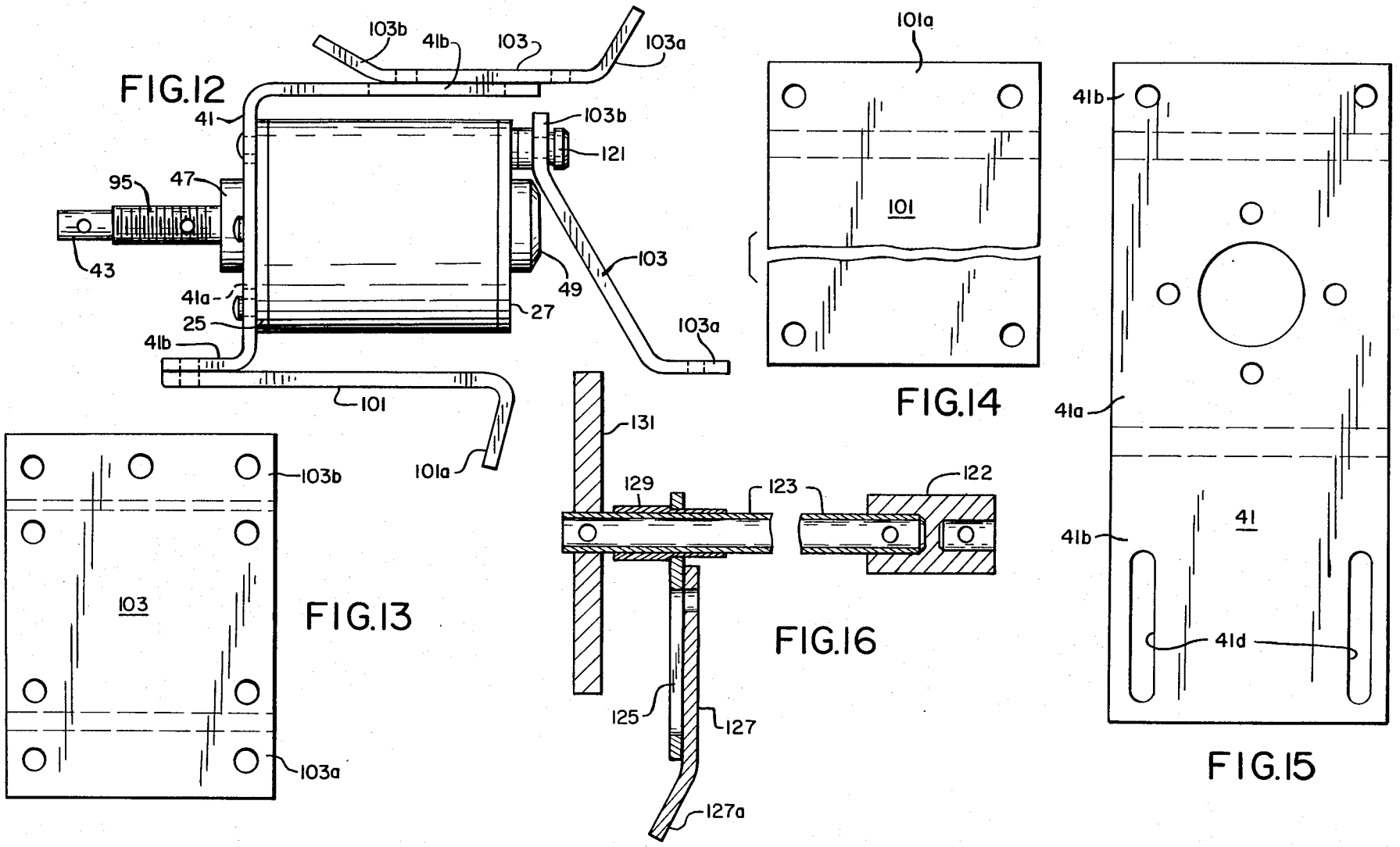
FIG. 12 is a side elevational view of the antenna mount showing the top brace plate in optional locations.
FIG. 13 is a plan view of the top brace plate prior to its being bent.
FIG. 14 is a plan view of the bottom plate prior to its being bent.
FIG. 15 is a view of the main mounting plate prior to its being bent.
FIG. 16 is a midsectional view through an optional remote control kit.

My antenna mount, as shown in FIGS. 1 and 12, comprises a hollow body generally entitled 21 made up of a cylindrical sleeve 23, and disc-like front and rear plates 25 and 27, respectively, the parts being held together by machine screws 29. The latter also secures a main mounting plate 41 to the body, specifically by securing its central leg 41*a* to the front plate 25, and pass through clearance holes formed in the main mounting plate and the front plate and thread through threaded holes in the rear plate 27.

A shaft 43, which carries an antenna bracket 45, is mounted on the body 21 in the following manner. It rotatably and slidably projects through a front bushing 47 and fixedly fits in a bore formed in rear bushing 49. The front bushing 47 has an internal shouldered fit with the front plate 25 and is sealingly secured thereto in any suitable fashion. I have used "LocTite" 290 wicking adhesive/sealant for this purpose. The rear bushing rotatably and slidably extends through a hole provided in the rear plate 27, there being an O-ring seal at 51 between the rear bushing and the rear plate. There is also an O-ring seal at 53 between the shaft 43 and the front bushing 47.

Figure 18:
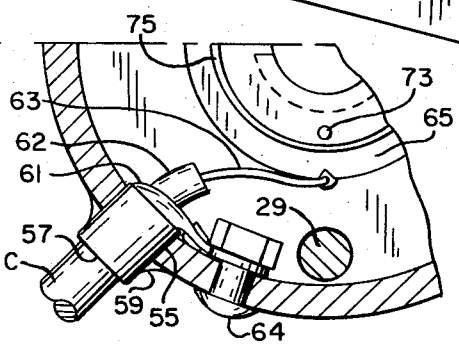
FIG. 18 is a fragmentary cross sectional view of a related portion.
Figure 17:
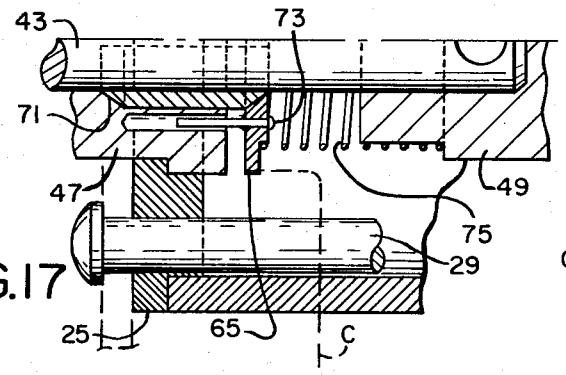
FIG. 17 is a fragmentary longitudinal sectional view of a portion of the mount.

Means are provided whereby a coaxial cable C may be electrically connected to the shaft 43 and mechanically connected to the body 21. This arrangement is shown in FIGS. 1, 17 and 18. I provide a hole 55 (FIG. 18) in the sleeve 23 for passage of the cable C. I prefer to use a section of shrink tube 57 around the coax cable at the hole for wear purposes. A suitable sealant 59, such as "COAX-SEAL", is provided at the joint at the hole 55 to keep water out of the body 21.

The shrink tube extends only through the body, thus exposing the outer layer of insulation of the cable, which is cut away to expose the coaxial sheath 61. The inner insulating layer 62 is cut away to expose the inner electrical conductor 63.

The sheath is connected to the interior of the body 21 by a grounding screw 64 as shown in FIG. 18 to establish not only an electrical ground connection from the cable to the body, but also to establish a mechanical connection to the body. Thus the sealant 59 at the joint between the cable and the sleeve is not relied upon for holding the cable in place.

The conductor 63 is soldered into a notch (FIG. 18) provided in a contact washer 65 which is internally beveled to match a bevel on one set of ends of a pair of split contact cones 71 (FIGS. 1 and 17). The cones slidably embrace the shaft 43 but permit axial movement of the shaft relative to the cones while maintaining electrical contact therewith. The left hand ends of the contact cones are beveled to match a bevel on the interior of the front bushing 47. A pin 73 (FIGS. 1 and 17) carried by the contact washer extends into a bore provided in the front bushing, to preclude rotary movement between the contact washer and the bushing. Thus no flexing in the electrical connection between the coax cable and the contact washer is required when adjusting the antenna's position.

A compression spring 75 (FIG. 17) is arranged between the contact washer 65 and the rear bushing 49, suitable centering bosses being provided on each of such members to properly locate the compression spring in coaxial relation to the shaft 43.

The spring 75 forces the contact cones into such contact with the shaft 43 as to establish a good radio frequency energy connection.

A roll pin 81 (FIG. 1) fixedly projects through and is carried by the rear bushing 49. The exposed ends of the roll pin function as detents and are adapted to selectively seat in a series of grooves 83 formed on the inner face of the rear plate 27.

In the particular embodiment of the invention shown, two sets of grooves (FIG. 8) are provided, one set being located at 90 degrees from the other. Hence, the ends of the roll pin may selectively fit in any of the sets of grooves in a manner to be presently recited.

The bracket 45, previously mentioned, is of right angular form, in the particular embodiment of the invention shown. Its vertical leg is bored to receive the shaft 43. On either side of the shaft are one or more friction washers such as silicon-bronze or Belleville washers 91. The washers are held in frictional engagement with the bracket by means of a pair of nuts 93, which thread on a threaded portion 95 (FIG. 6) of shaft 43. The inner nut is fixed to the shaft 43. In practice, the outer nut is threaded with sufficient tightness against the washers 91 so as to firmly hold the antenna in place against the forces of inertia, wind resistance, etc., but will enable the antenna to be forced to a lowered position by inadvertent engagement with an object, should the owner have failed to lower the antenna. Thus, the frictional engagement at the washers 91 is a fail-safe arrangement. The bracket is formed with a hole 97 to enable the lower end of a transceiver antenna to be secured to the bracket.

There are a number of places where my antenna mount could be used for mounting a transceiver antenna in place. A few of these will be described. One typical position is at the "corner" of the vehicle roof at the driver's side. By "corner" is meant the general area of curved transition between the roof and the side wall of a vehicle. FIG. 12 shows that there is a bottom mounting plate 101 which can be bolted to a leg 41*b* of the main mounting plate, whereby to locate a leg 101*a* of the bottom mounting plate in position for engagement with the side wall of a vehicle body.

As shown in FIG. 12, the unit is also equipped with a top brace plate 103 which can be adjustably secured to the upper leg 41*b* of the main mounting plate, the main mounting plate being provided with elongate slots 41*d* as shown in FIG. 15 for adjustable connection. The top brace plate 103 has an angularly related mounting leg 103*a* arranged in position to contact the upper portion of the side wall of the vehicle frame. The top brace plate also has a second angularly related leg 103*b* which is bent to a lesser extent, so that the top brace plate can be reversed end-for-end for better flush mounting of the bent end portions against various vehicle body shapes and styles.

If the mount is secured as above described, which for brevity I will call "corner mounting", I can provide for adjustment of the position of the antenna from the interior of the vehicle as follows: the driver lowers the driver's window, reaches out with his left hand, grasps the mount at the bracket 45, pulls out to separate the roll pin 81 detents from the grooves 83. The driver then turns the antenna 90 degrees from its upright position to its lowered position, at which time the driver allows the compression spring 75 to reseat the roll pin detents, but now back in the set of grooves 83 which are 90 degrees from the "upright" set.

I also provide an arrangement permitting adjustment of the antenna position from the interior of the vehicle, and without having to lower any of the windows.

This is particularly useful in areas of extremes of temperature, such as operations on the Alaskan North Slope.

What I do is to replace the rear bushing 49 with a bushing 109 (FIG. 10), the dimensions of which are such that its right-hand face as the parts are shown in FIG. 10 will be in contiguous relation to the side wall of the vehicle body. A hole will then be formed through the body wall of a size to receive a suitable grommet for sealing purposes, the grommet having a hole of a size to receive the shaft portion 113 of a handle so that there is a seal provided around the handle of the shaft at the place it projects through the vehicle side wall.

The bushing 109 is provided with an externally exposed blind bore 111 for fixed reception of the shaft 113 of a handle. The handle has a hand-grasping cross bar 115, as shown in FIG. 11.

Now, when it is decided to adjust the position of the antenna, the handle is pushed outwardly to unseat the roll pin detents 81 from one set of grooves and enable the operator to thereafter turn the antenna 90 degrees to a lowered position where the roll pin detents will seat in the other set of grooves.

In certain special installations where the vehicle mount is located at a substantial height, it may be desirable to permit the driver to turn the antenna to a position 180 degrees from its normal elevated operative position. This can be readily accomplished by simply pushing in the handle and turning the antenna 180 degrees, whereupon the driver will release the pressure on the compression spring enabling the roll pin detents to reseat in the appropriate grooves. The same result can be achieved without the inner handle feature, by simply pulling out on the bracket 45 to unseat the roll pin detents and enabling the bracket to be turned either 90 degrees or 180 degrees, as suits the driver of the vehicle.

Another common place for mounting an antenna is at the center of the roof rather than at the corners. When this is to be done, I remove the bottom mounting plate 101, and mount the body 21 in place by means of the lower leg 41*b* and also by the leg 103*a* of the top brace plate 103, which has been relocated and mounted on an extension of one of the machine screws 29 by means of a nut 121. In making the above installation, the headliner for the interior of the vehicle roof is removed an extent to enable the mounting to be accomplished and also to enable the bottom mounting plate 101 to be placed against the inside of the roof for reinforcement purposes, where it can be secured in sandwich fashion to the main mounting plate, with the roof of the vehicle intervening between the two mounting plates. In the event there is insufficient clearance for the leg 101*a* of the bottom mounting plate, that portion can be readily bent to an in-line, out-of-the-way position.

Also note that while the headliner is down, the coaxial cable will be fitted through a grommeted hole provided in the roof for appropriate connection to contact washer 65 within the interior of the body, as previously described.

When the mount is "center mounted" the owner, by standing next to the vehicle, has the option of swinging the antenna from its elevated to its lowered position.

As an option, the antenna may be adjusted with the driver remaining in the vehicle. Referring to FIG. 16, I provide a remote control kit which includes an insulating coupling collar 122 for securement to the free end of the shaft 43 at one of its ends and to a remote control shaft 123 on its opposite end. The shaft extends across the top of the vehicle toward the driver's side, where it is there supported by a bracket comprising a pair of bracket members 125 and 127.

Bracket 125 is provided with elongate slots for adjustable connection to bracket member 127 to properly locate the upper end of bracket 125 relative to the antenna mount. The lower end of bracket member 127 has a bent leg 127*a* for securement to the corner of the roof at the driver's side.

The upper end of the bracket member 125 is bored to receive a mounting sleeve 129 which has a shouldered fit with the bracket member 125. The remote control shaft extends through the sleeve 129 and has a cross bar handle 131 similar to the handle in FIG. 11. The cross bar handle is secured to the left hand end of the remote control shaft as the parts are shown in FIG. 16, and thus is located in position where the driver of the vehicle by lowering the window at the driver's side can reach out, grasp the handle 131 and appropriately adjust the position of the antenna while the vehicle is at rest or while it is moving.

The remote control shaft 123 as furnished, would have a length exceeding that of the anticipated usages, enabling the owner to cut it to size for proper location of the handle for ready access to the driver's hand.

I anticipate my antenna mount will be used in temperature zones of normal climatic variations and also in places where the temperature goes from one extreme to the other. While there may be considerable variation in the materials used in constructing my device, depending on where it is intended to be used, I do have some material preferences. The front bushing 47 should be of dielectric material to electrically insulate the shaft 43 from the body 21. I anticipate that the front and rear plates will be metal, although that is not a limitation. The sleeve 23 will be of metal, if it is used as a ground member. It may be of dielectric material, but if so, grounding must be made to one of the other metal members.

The rear bushing 49 will also be of dielectric material to isolate the electrically conductive shaft 43 from the body. I have found that one or several kinds or types of Nylatron plastic have proved useful and are resistive to drastic temperature changes.

Figure 21:
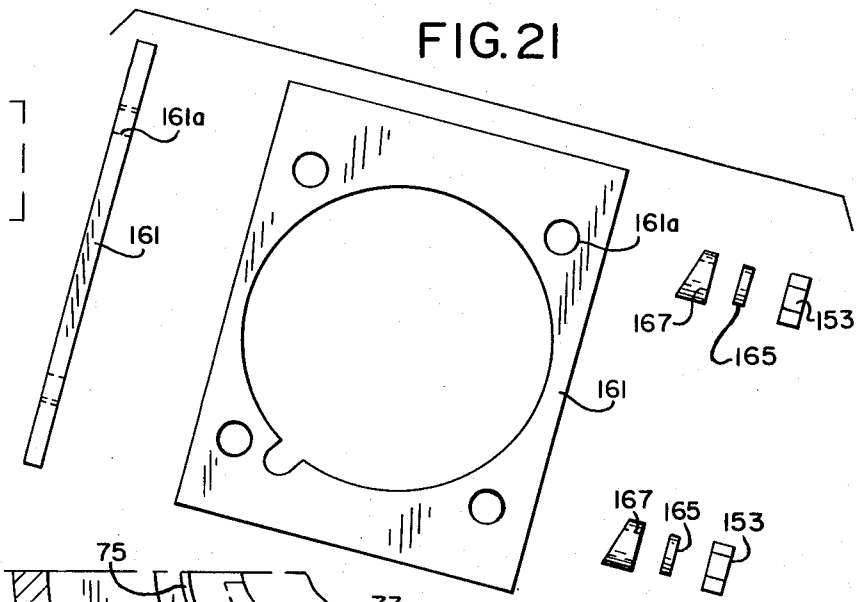
FIG. 21 is a view of other parts of the in-the-wall mounting arrangement.
Figure 19:
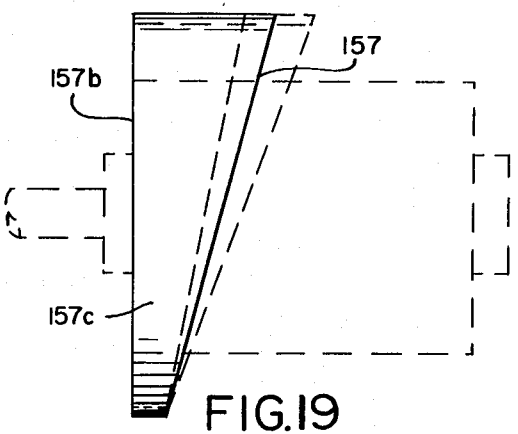
FIG. 19 is a side view of an in-the-wall mounting piece.
Figure 20:
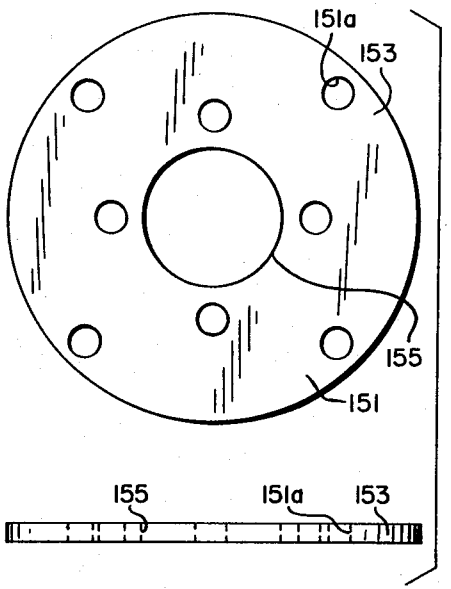
FIG. 20 shows face and edge views of a front ring used with such piece.

FIGS. 19–21 show an adapter arrangement for in-the-wall mounting of an antenna, so as to present a "streamlined" look for those vehicle owners who want the ultimate in appearance as well as function.

The in-the-wall mounting arrangement would utilize the entirety of the parts shown in FIG. 1, except for the main mounting plate 41. The latter is removed and replaced by a disc-like front ring 151 (FIG. 20) which has holes 153 for accommodating the screws 29. The ring also has a central hole 155 to accommodate the front end of the bushing 47. Behind the ring is an adapter member 157 of tubular cross sectional form but wedge shaped in side view. The angle (or contour, if necessary) of the rear edge of the adapter member 157 is selected to complement the inclination (or contour) of the side wall of the vehicle, so that the front face 157*b* of the adapter member 157 is vertical.

The body 21 fits through a central hole 157*c* of the adapter member to abut against the rear face of the front ring 151.

The above assembly is mounted in place by long machine screws, not shown, which extend through holes 151*a* formed in the front ring 151, through the tubular member 157 and through holes in the vehicle wall, and then through holes 161*a* formed in a backing plate 161. The above parts are clamped together by nuts 153 (FIG. 21) which thread on the screws and up against lock washers 165, which in turn bear against wedge washers 167 which bear against the back of plate 161.

From the above description, it is evident that the in-the-wall mounting conceals a substantial portion of the antenna mounting behind the side wall of the vehicle and conceals the projecting portion of the mount by means of the adapter member and the front ring. Thus, there is a minimum of mechanical components exposed at the exterior of the vehicle which the very particular might consider unsightly.

What is claimed is:

1. In an antenna mount, a mount body, antenna mounting means for mounting an antenna whip on said body for movement from a vertical position to one or more other positions, said antenna mounting means including an antenna mounting member, said antenna mounting means including a shaft carrying said antenna mounting member and mounted by said antenna mounting means for turning movement about a predetermined axis to provide for movement of an antenna to the above recited positions, said antenna mounting means also mounting said shaft for axial movement along said predetermined axis, positive locking means for locking said antenna mounting member in positions corresponding to said above recited positions, and releasable upon axial movement of said shaft to permit turning movement of said shaft to change the position of the antenna mounting member, friction clutch holding means independent of said locking means and being interposed between said shaft and said mounting member providing for forced turning movement of said antenna mounting member and thus the antenna whip relative to said shaft despite the shaft being held in a fixed position by said positive locking means.

2. An antenna mount as described in claim 1 wherein said locking means includes a pair of interlocking members mounted for axial separation and for selective engagement in plural circumferential positions, and compression spring means urging said interlocking members into engagement.

3. An antenna mount as described in claims 1 or 2 wherein said friction clutch holding means includes clamp means clampingly mounting said antenna mounting member onto said shaft by the application of axial thrust forces against said antenna mounting member, and friction means interposed between said clamp means and said antenna mounting member permitting forced movement of said antenna independently of said locking means.

4. In an antenna mount, a hollow body, an antenna mounting shaft extending into said hollow body, for supporting an antenna mounting bracket and associated antenna.

insulating means for mounting said shaft on said body including a tubular insulating member in direct slidable engagement with said shaft and at least in part supporting said shaft and being in fixed relation to said hollow body, said shaft being turnable relative to said tubular insulating member to facilitate adjustment of the position of the antenna whip, first electrical split cone contact means, compressably engaging said shaft to establish electrical contact therewith while permitting relative motion thereto, second electrical contact means in electrical and physical contact with said first electrical contact means, means preventing turning movement of said second electrical contact means with said shaft, means for securing one electrical conductor of a coax cable to said second electrical contact means, and means for securing the other conductor of the coax cable to said body.

5. An antenna mount as recited in claim 4 in which the hollow body includes a dielectric bushing for mounting said shaft for rotary and axial movements and being in direct contact with said shaft, and means for continuously biasing said split cone contact means radially into engagement with said shaft.

6. In an antenna mount, a metal body to be mounted on a vehicle body shell in electrical contact therewith, a shaft for supporting an antenna mounting bracket and associated antenna whip and being mountable on said metal body in electrical insulated relation thereto, contact means for engaging said shaft and establishing an electrical contact therewith, means for connecting the center wire of a coaxial cable to said contact means, means for connecting the outer conductor of the coaxial cable to said metal body, and through it to the vehicle body shell which is at a ground potential and thus with said antenna whip, becomes an essential part of a ground plane transmitting antenna, separable interlocking members for releasably locking said shaft in any of a plurality of circumferential positions, said members being separable on axial sliding movement of said shaft, and dual function compression spring means interposed between at least a certain one of said interlocking members and said contact means to urge said interlocking members into engagement with one another and said contact means into engagement with said shaft.

* * * * *